US007460686B2

(12) United States Patent
Yoda et al.

(10) Patent No.: US 7,460,686 B2
(45) Date of Patent: Dec. 2, 2008

(54) SECURITY MONITOR DEVICE AT STATION PLATFORM

(75) Inventors: Ikushi Yoda, Ibaraki (JP); Katsuhiko Sakaue, Ibaraki (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 322 days.

(21) Appl. No.: 10/522,164

(22) PCT Filed: Jul. 24, 2003

(86) PCT No.: PCT/JP03/09378

§ 371 (c)(1),
(2), (4) Date: Oct. 14, 2005

(87) PCT Pub. No.: WO2004/011314

PCT Pub. Date: Feb. 5, 2004

(65) Prior Publication Data

US 2006/0056654 A1 Mar. 16, 2006

(30) Foreign Application Priority Data

Jul. 25, 2002 (JP) ..... 2002-217222

(51) Int. Cl.
*G06K 9/00* (2006.01)

(52) U.S. Cl. ..... 382/103; 382/106; 382/107; 382/154; 382/278; 348/135; 348/700

(58) Field of Classification Search ..... 382/103
See application file for complete search history.

(56) References Cited

U.S. PATENT DOCUMENTS

| | | | | | |
|---|---|---|---|---|---|
| 4,695,959 | A | * | 9/1987 | Lees et al. | 701/225 |
| 4,893,183 | A | * | 1/1990 | Nayar | 348/135 |
| 4,924,506 | A | * | 5/1990 | Crossley et al. | 382/286 |
| 5,176,082 | A | * | 1/1993 | Chun et al. | 104/28 |
| 5,592,228 | A | * | 1/1997 | Dachiku et al. | 348/416.1 |

(Continued)

FOREIGN PATENT DOCUMENTS

JP 7-73388 3/1995

(Continued)

OTHER PUBLICATIONS

Machine translation of Japanese Publication 7-22850.*

*Primary Examiner*—Matthew C Bella
*Assistant Examiner*—Sath V. Perungavoor
(74) *Attorney, Agent, or Firm*—Oblon, Spivak, McClelland, Maier & Neustadt, P.C.

(57) ABSTRACT

The present invention provides a more reliable safety monitoring device on the station platform, where the safety monitoring device detects the fall of a person on the platform edge on the railroad-track side onto a railroad track with stability, recognizes at least two persons, and obtains the entire action log thereof. The present invention recognizes the person at the platform edge by distance information and texture information and determines the position on the platform edge. At the same time, the present invention detects the case where the person falls onto the railroad track with stability and automatically transmits a stop signal or the like. At the same time, the present invention transmits an image of the corresponding camera. Further, the present invention records the entire action of all persons moving on the platform edge.

5 Claims, 19 Drawing Sheets

U.S. PATENT DOCUMENTS

| | | | | | |
|---|---|---|---|---|---|
| 5,751,831 | A | * | 5/1998 | Ono | 382/103 |
| 5,838,238 | A | * | 11/1998 | Abita et al. | 340/573.1 |
| 5,933,082 | A | * | 8/1999 | Abita et al. | 340/541 |
| 6,064,749 | A | * | 5/2000 | Hirota et al. | 382/103 |
| 6,167,143 | A | * | 12/2000 | Badique | 382/107 |
| 6,188,777 | B1 | * | 2/2001 | Darrell et al. | 382/103 |
| 2004/0105579 | A1 | * | 6/2004 | Ishii et al. | 382/154 |
| 2006/0056654 | A1 | * | 3/2006 | Yoda et al. | 382/103 |

FOREIGN PATENT DOCUMENTS

| | | | |
|---|---|---|---|
| JP | 7-228250 | * | 8/1995 |
| JP | 9-93565 | | 4/1997 |
| JP | 9-097337 | | 4/1997 |
| JP | 9-193803 | | 7/1997 |
| JP | 10-304346 | | 11/1998 |
| JP | 10-341427 | | 12/1998 |
| JP | 2000-184359 | | 6/2000 |
| JP | 2001-134761 | | 5/2001 |
| JP | 2001-143184 | | 5/2001 |
| JP | 2003-246268 | | 9/2003 |

* cited by examiner f1 f2 f3

| |
|---|
| f1 = (27 54 54 54 54 81 81 81 81 81 81 81 81 81 81 81 81 81 81 81 81 81 81 81) |
| f2 = (27 55 54 54 54 82 82 82 82 82 82 82 82 82 82 82 82 82 82 82 82 82 82 82) |
| f3 = (25 51 51 51 51 77 77 77 77 76 77 77 77 77 77 77 76 76 76 77 77 77 77 76 76) |

FIG. 14

No.1 =

| | | |
|---|---|---|
| * | * | * |
| * | 1 | * |
| * | * | * |

No.2 = ( + + + )/4

| | | |
|---|---|---|
| * | * | * |
| * | 1 | 1 |
| * | * | * |

| | | |
|---|---|---|
| * | * | 1 |
| * | 1 | * |
| * | * | * |

| | | |
|---|---|---|
| * | 1 | * |
| * | 1 | * |
| * | * | * |

| | | |
|---|---|---|
| 1 | * | * |
| * | 1 | * |
| * | * | * |

No.3 = ( + + + )/4

| | | |
|---|---|---|
| * | * | * |
| 1 | 1 | 1 |
| * | * | * |

| | | |
|---|---|---|
| * | * | 1 |
| * | 1 | * |
| 1 | * | * |

| | | |
|---|---|---|
| * | 1 | * |
| * | 1 | * |
| * | 1 | * |

| | | |
|---|---|---|
| 1 | * | * |
| * | 1 | * |
| * | * | 1 |

No.4 = ( + + + )/4

| | | |
|---|---|---|
| * | * | 1 |
| 1 | 1 | * |
| * | * | * |

| | | |
|---|---|---|
| 1 | * | * |
| * | 1 | * |
| * | 1 | * |

| | | |
|---|---|---|
| * | * | * |
| * | 1 | 1 |
| 1 | * | * |

| | | |
|---|---|---|
| * | 1 | * |
| * | 1 | * |
| * | * | 1 |

No.5 = ( + + + )/4

| | | |
|---|---|---|
| * | 1 | * |
| * | 1 | * |
| 1 | * | * |

| | | |
|---|---|---|
| * | * | * |
| 1 | 1 | * |
| * | * | 1 |

| | | |
|---|---|---|
| * | * | 1 |
| * | 1 | * |
| * | 1 | * |

| | | |
|---|---|---|
| 1 | * | * |
| * | 1 | 1 |
| * | * | * |

No.6 = ( + + + )/4

| | | |
|---|---|---|
| * | * | * |
| * | 1 | 1 |
| * | 1 | * |

| | | |
|---|---|---|
| * | 1 | * |
| * | 1 | 1 |
| * | * | * |

| | | |
|---|---|---|
| * | 1 | * |
| 1 | 1 | * |
| * | * | * |

| | | |
|---|---|---|
| * | * | * |
| 1 | 1 | * |
| * | 1 | * |

No.7 = ( + + + )/4

| | | |
|---|---|---|
| * | * | 1 |
| * | 1 | * |
| * | * | 1 |

| | | |
|---|---|---|
| 1 | * | 1 |
| * | 1 | * |
| * | * | * |

| | | |
|---|---|---|
| 1 | * | * |
| * | 1 | * |
| 1 | * | * |

| | | |
|---|---|---|
| * | * | * |
| * | 1 | * |
| 1 | * | 1 |

No.8 =

| | | |
|---|---|---|
| * | * | * |
| * | 2 | * |
| * | * | * |

No.9 =

| | | |
|---|---|---|
| * | * | * |
| * | 3 | * |
| * | * | * |

No.10 = ( + + + )/4

| | | |
|---|---|---|
| * | * | * |
| * | 2 | 1 |
| * | * | * |

| | | |
|---|---|---|
| * | * | 1 |
| * | 2 | * |
| * | * | * |

| | | |
|---|---|---|
| * | 1 | * |
| * | 2 | * |
| * | * | * |

| | | |
|---|---|---|
| 1 | * | * |
| * | 2 | * |
| * | * | * |

No.11 = ( + + + )/4

| | | |
|---|---|---|
| * | * | * |
| * | 1 | 2 |
| * | * | * |

| | | |
|---|---|---|
| * | * | 2 |
| * | 1 | * |
| * | * | * |

| | | |
|---|---|---|
| * | 2 | * |
| * | 1 | * |
| * | * | * |

| | | |
|---|---|---|
| 2 | * | * |
| * | 1 | * |
| * | * | * |

SECURITY MONITOR DEVICE AT STATION PLATFORM

TECHNICAL FIELD

The present invention relates to a safety monitoring device in a station platform and particularly relates to a safety monitoring device at an edge of a station platform on the rail-road side, the safety monitoring device using distance information and image (texture) information.

BACKGROUND ART

In the past, various types of station-platform safety monitoring devices have been proposed (refer to Japanese Unexamined Patent Application Publication No. 10-304346, Japanese Unexamined Patent Application Publication No. 2001-341642, Japanese Unexamined Patent Application Publication No. 2001-26266, Japanese Unexamined Patent Application Publication No. 2001-39303, Japanese Unexamined Patent Application Publication No. 10-341727, and so forth).

For example, as disclosed in Japanese Unexamined Patent Application Publication No. 10-304346, camera systems for monitoring the edge of a station platform, as shown in FIG. 2, are known. Such systems are installed at a nearly-horizontal angle so that a single camera can capture a long distance of about 40 meters in a lateral direction. Further, such systems are configured so that the images of several cameras are displayed in an image on a single screen, so as to be visually recognized by a person.

Therefore, an image-object area to be visually recognized is long (deep). Where many passengers come and go, passengers are hidden behind other passengers, which makes it difficult to see all the passengers. Further, since the cameras are installed at nearly horizontal angles, they are easily affected by the reflection of morning sunlight, evening sunlight, and other light, which often makes it difficult to pick up images properly.

Further, where a person falls onto a railroad track, a fall-detection mat shown in FIG. 3 detects the person fall by detecting the pressure thereof. However, since the fall-detection mat can be provided only on an inward part between the railroad track and the platform due to its structure. Therefore, where the person jumps over the detection mat when he fells, the detection mat is entirely useless.

For improving the above-described systems, Japanese Unexamined Patent Application Publication No. 13-341642 discloses a system in which a plurality of cameras is installed in a downward direction under the roof of a platform, so as to monitor an impediment.

The system calculates the difference between an image where no impediments are shown therein and a current image. Where any difference is output, the system determines that an impediment is detected. Further, Japanese Unexamined Patent Application Publication No. 10-311427 discloses a system configuration for detecting motion vectors of an object for the same purpose as that of the above-described system.

However, those systems often fail to detect impediments, especially for varying light and shadow. Therefore, those systems are not good enough to be used as monitoring systems.

DISCLOSURE OF INVENTION

The object of the present invention is to provide a safety monitoring device on a station platform, the safety monitoring device being capable of stably detecting the fall onto a railroad track of a person at the edge of a platform on the railroad side, identifying at least two persons, and obtaining the entire action log thereof.

In the present invention, the plurality of cameras photographs the edge of the platform so that the position of a person at the platform edge is determined by identifying the person at the edge of the platform using distance information and texture information. At the same time, the present invention allows detecting stably the fall of a person onto the railroad track and automatically transmitting a stop signal or the like. At the same time, the present invention allows transmitting an image of the corresponding camera. Further, the present invention allows recording the entire actions of all the persons moving on the platform edge.

Further, the present invention provides means for previously recording the states where a warning should be given in advance according to the position, movement, and so forth of a person on the edge of a platform and the state where the announcement and image thereof are transferred. Further, a speech-synthesis function is added to the cameras so that the announcements corresponding to the states are made for passengers per camera by previously-recorded synthesized speech.

That is to say, the safety monitoring device on the station platform of the present invention is characterized by including image processing means for picking up a platform edge through a plurality of stereo cameras at the platform edge on the railroad-track side of a station and generating image information based on a picked-up image in the view field and distance information based on the coordinate system of the platform per stereo camera, means for recognizing an object based on distance information and image information transmitted from each of the stereo cameras, and means for confirming safety according to the state of the extracted recognized object.

Further, in the above-described system, means for obtaining and maintaining the log of a flow line of a person in a space such as the platform is further provided.

Further, the means for extracting a recognition object based on the image information transmitted from the stereo cameras performs recognition using a higher-order local autocorrelation characteristic.

Further, in the above-described system, the means for recognizing the object based on both said distance information and image information discerns between a person and other things from barycenter information on a plurality of masks at various heights.

Further, in the above-described system, the means for confirming the safety obtains said distance information and image information of the platform edge, detects image information of above a railroad-track area, recognizes the fall of a person or the protrusion of a person or the like toward outside the platform according to the distance information of the image information, and issues a warning.

Further, said higher-order local autocorrelation characteristic is used for determining ahead and behind time-series distance information existing at predetermined positions in a predetermined area, as one and the same person.

Further, the predetermined positions correspond to a plurality of blocks obtained by dividing the predetermined area, and a next search for the time-series distance information is performed by calculating the higher-order local autocorrelation characteristic per at least two blocks of said plurality of blocks.

BRIEF DESCRIPTION OF THE DRAWINGS

FIG. 14 illustrates a translation-invariant and rotation-invariant higher-order local autocorrelation characteristic used for the present invention.

BEST MODE FOR CARRYING OUT THE INVENTION

Figure 1:
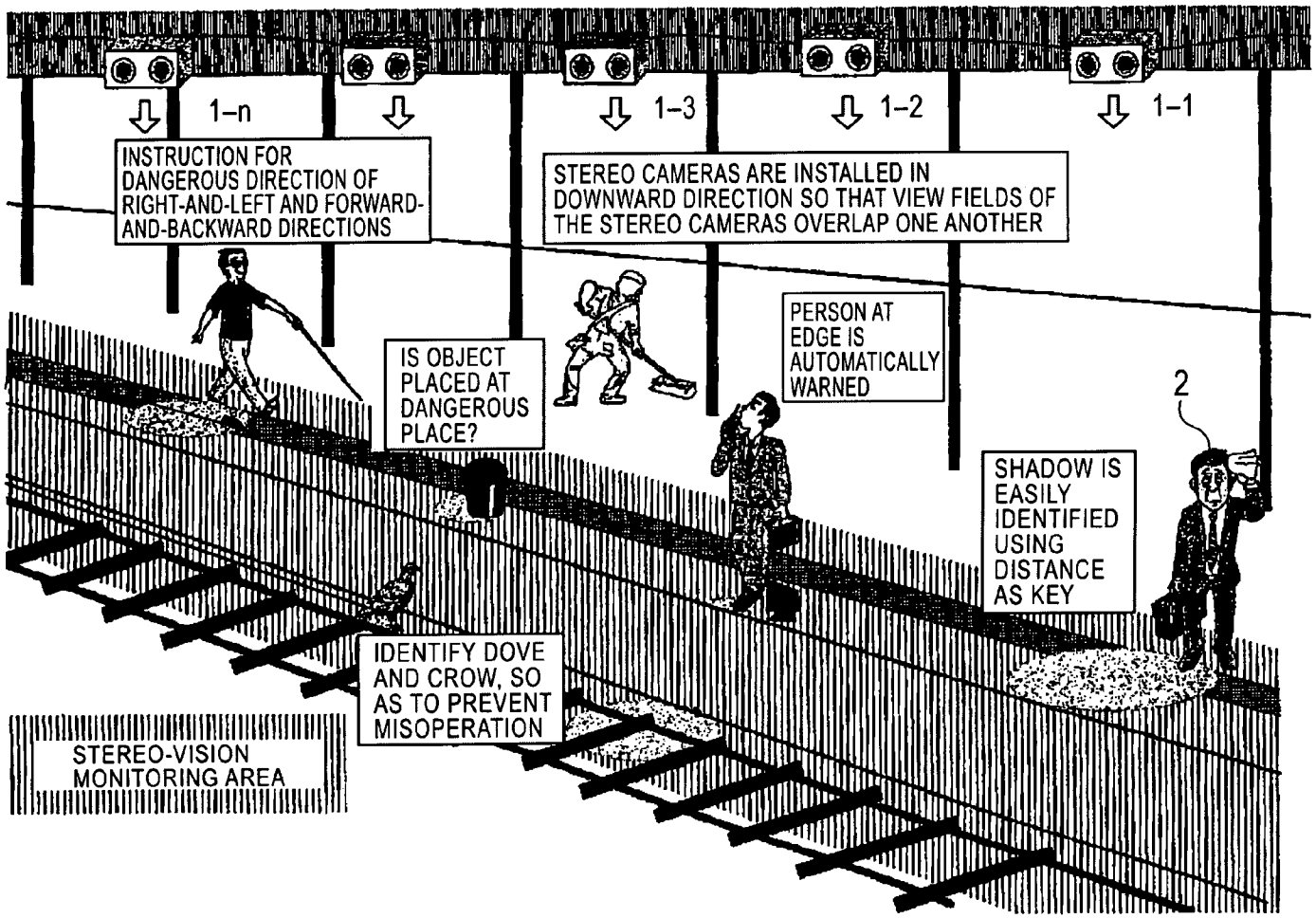
FIG. 1 is a conceptual illustration of a safety monitoring device according to the present invention.
Figure 2:
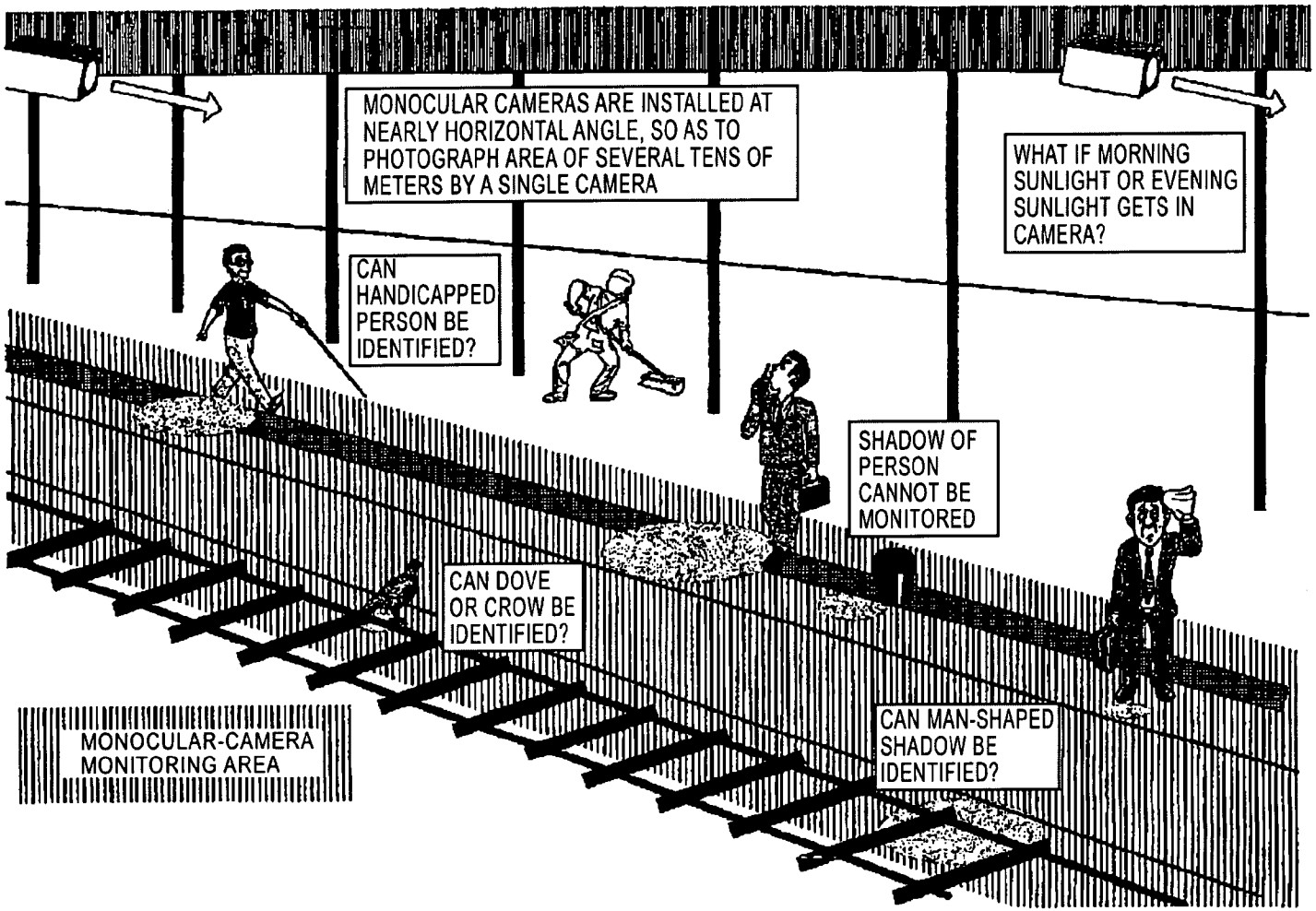
FIG. 2 shows the positions of known monitoring cameras.
Figure 3:
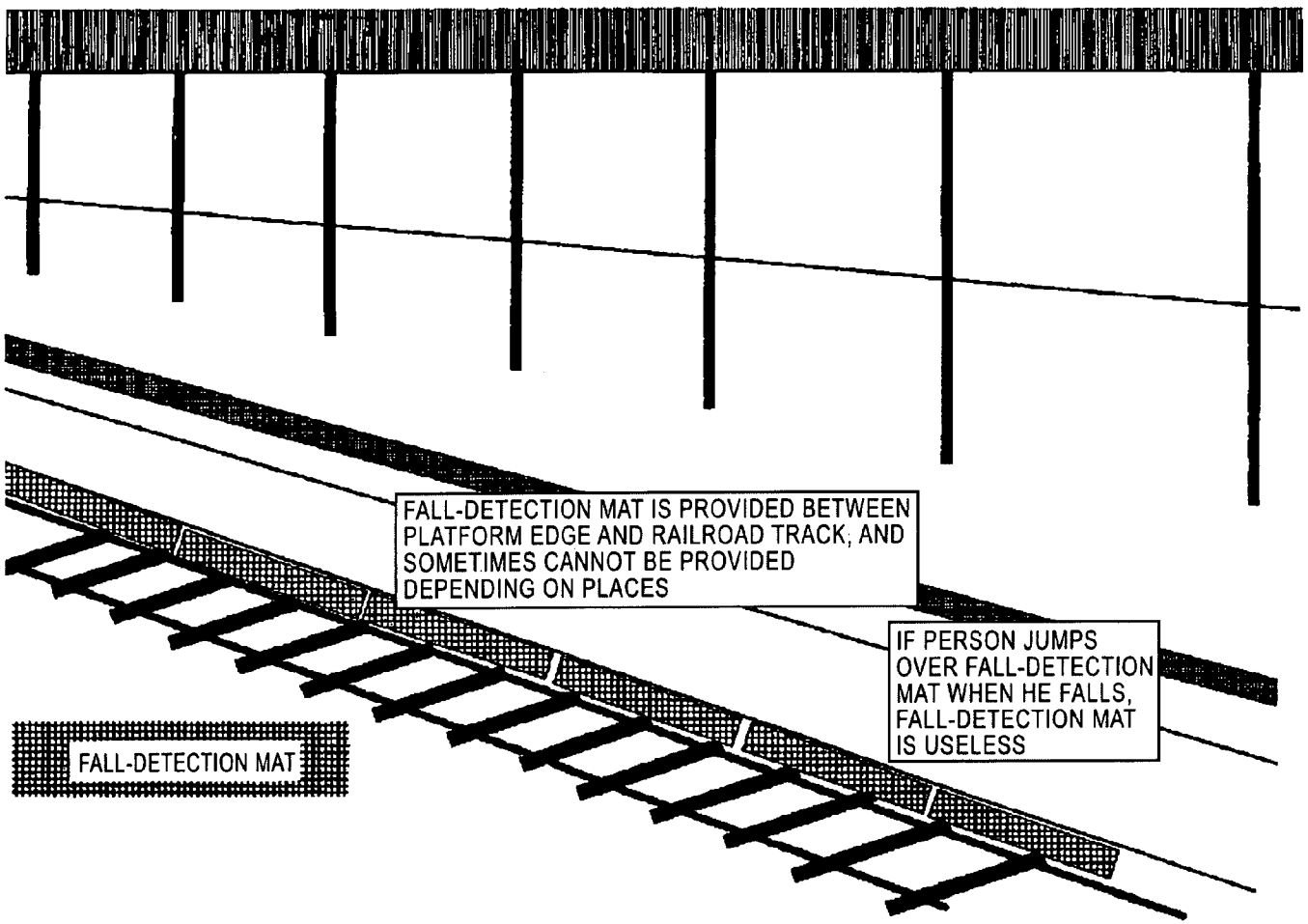
FIG. 3 illustrates known fall-detection mats.
Figure 4:
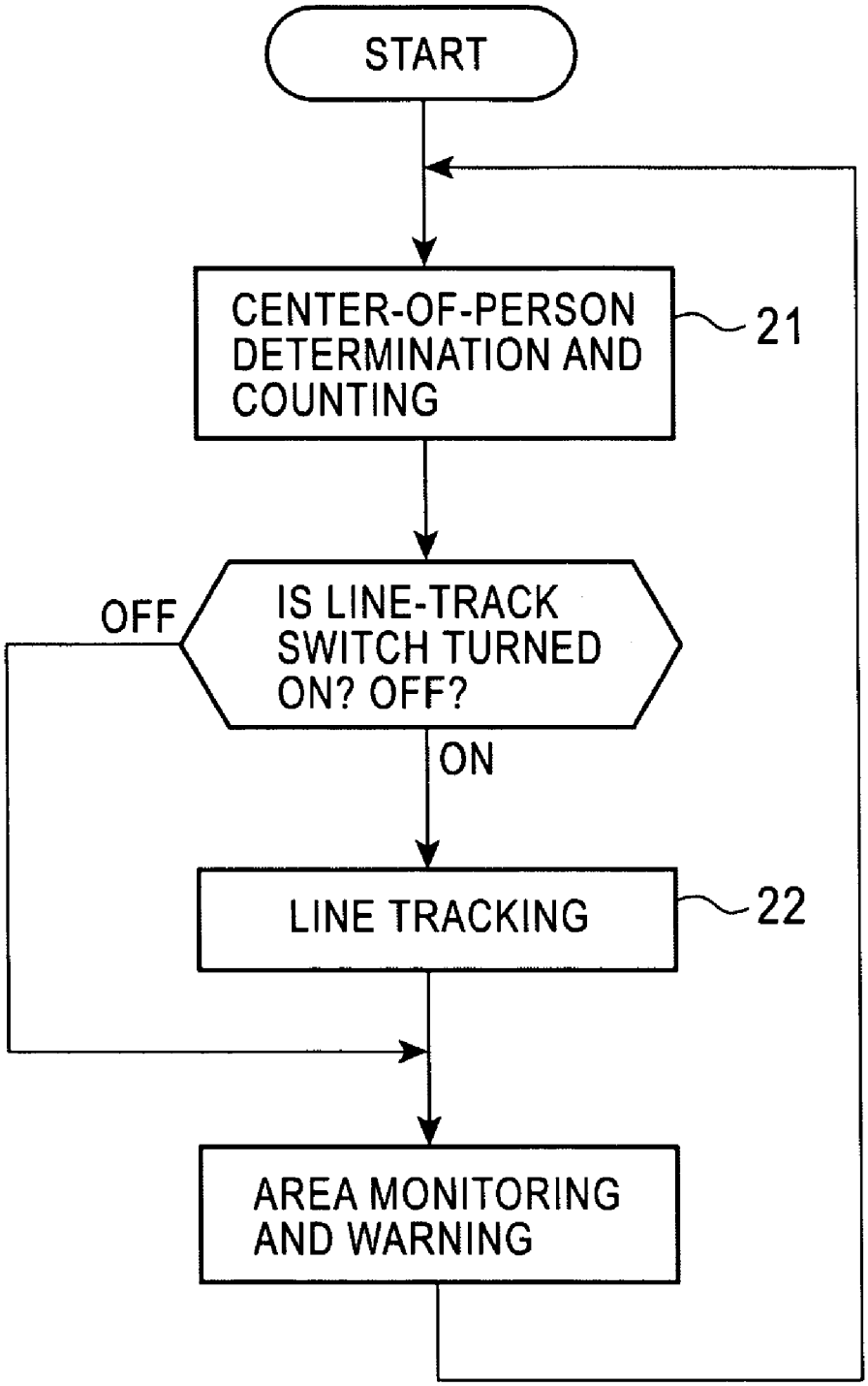
FIG. 4 is a flowchart illustrating the entire present invention.

FIG. 1 schematically shows a system configuration according to an embodiment of the present invention and FIG. 4 shows a general flowchart of a data integration-and-identification device described in FIG. 1.

As shown in FIG. 1, a plurality of stereo cameras 1-1 to 1-n photographs the edge of a platform so that no blind spots exist and monitors a passenger 2 moving on the platform edge. Each of the stereo cameras 1 has at least two cameras whose image-pickup elements are fixed, so as to be parallel with each other. Therefore, image-pickup outputs from the stereo cameras 1-1 to 1-n are transmitted to an image-processing device in each camera. The stereo cameras have already been known. For example, Digiclops of Point Gray Research and Acadia of Sarnoff Corporation are used.

In the present invention, the fall of a person at the edge of a platform on the railroad side onto a railroad track is detected with stability, at least two persons are identified, and the entire action log thereof is obtained. The action log is obtained for improving the premises and guiding passengers more safely by keeping track of flow lines.

As has been described, in the present invention, the position of a person at the platform edge is determined by identifying the person at the platform edge according to distance information and image (texture) information (hereinafter simply referred to as texture). At the same time, the present invention allows detecting the fall of a person onto the railroad track with stability and automatically transmitting a stop signal or the like. At the same time, the present invention allows transmitting images of the corresponding camera. Further, the present invention allows recording the entire actions of all the people moving on the platform edge. As shown in FIG. 4, in the entire processing, first, the existence of a person is counted based on the distance information, as center-of-person determination-and-count processing 21. Further, the existence points of the person are connected in time sequence and a flow line is obtained, as line-tracking processing 22.

[Center-of-Person Determination-and-Count Processing]

Figure 5:
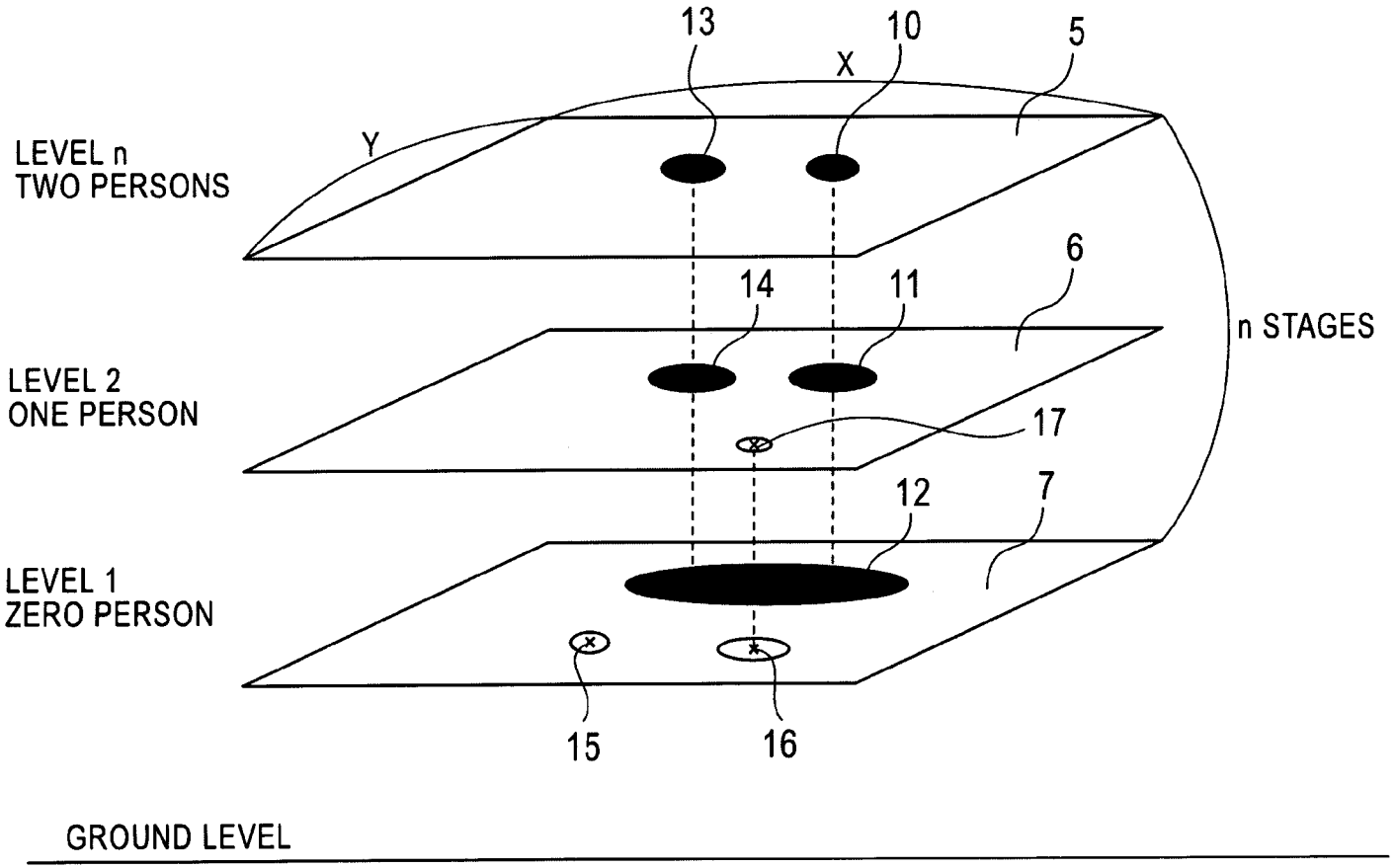
FIG. 5 illustrates a person-count algorithm of the present invention.

FIG. 5 is a conceptual illustration of a person-counting algorithm used for the above-described present invention. Further, FIG. 6 shows the flow of the person-counting algorithm.

The algorithm of a person counting-and-flow line measurement program will be described below.

Figure 6:
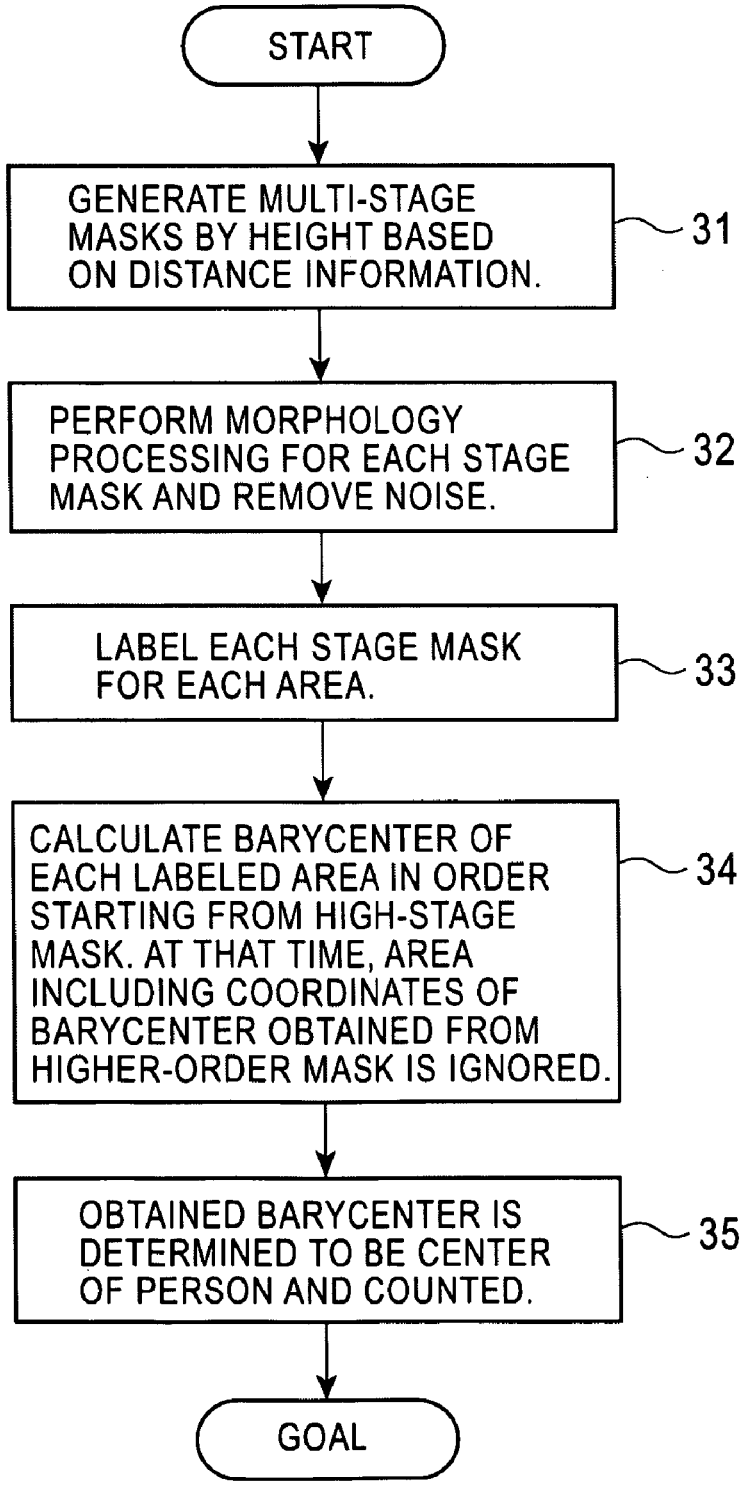
FIG. 6 is a flowchart showing center-of-person determination-and-count processing of the present invention.

[1] The distance of the z-axis is obtained and mask images (reference numerals 5, 6, and 7 of FIG. 5) or the like at different heights are generated using same (reference numeral 31 in FIG. 6). Further, a plane is defined according to the x-axis and the y-axis. The z-axis is determined to be the height direction. Further, even though only three-stage masks are shown in FIG. 5 for the sake of simplicity, eight-stage masks may be used in a preferred embodiment.

Since the stereo cameras are used for photographing and the distance information can be obtained, a binary image can be generated according to the distance information. That is to say, where the three masks shown in FIG. 5 are designated by reference numerals 5, 6, and 7 from the top in that order, the mask 5 detects the height of from 150 to 160 cm, the mask 6 detects the height of from 120 to 130 cm, and the mask 7 detects the height of from 80 to 90 cm, for example, according to the distance information, whereby a binary image is generated. The black portions (whose numerical value is one) of the masks shown in FIG. 5 indicate that something exists therein and white portions (whose numerical value is zero) indicate that nothing exists therein.

Since the cameras observe from on high, reference numerals 10, 11, and 12, or reference numerals 13, 14, and 12 on those masks indicate the existence of persons. For example, reference numeral 10 corresponds to the head and image data sets 11 and 12 exist on the masks on the same x-y coordinates. Similarly, reference numeral 13 corresponds to the head and image data sets 14 and 12 exist on the masks on the same x-y coordinates. Reference numeral 15 indicates a baggage, for example, and is not recognized, as a person. Dogs and doves are eliminated, since they do not have data on a plurality of images. Reference numerals 17 and 16 are recognized as a child who is short in height. As a result, three people including the child are recognized on the masks sown in FIG. 5 and the following processing is performed.

[2] Morphology processing is performed for the masks according to noise of each of the cameras (reference numeral 32 shown in FIG. 6). For reference sake, the morphology processing is a type of image processing for a binary image based on mathematical morphology. However, since the morphology processing has already been known and has no direct bearing on the present invention, the specific description thereof is omitted.

[3] The mask 5 at the top (the highest stage) is labeled (reference numeral 33 shown in FIG. 6) and the barycenter thereof is obtained (reference numeral 35 shown in FIG. 6). Similarly, the barycenter is obtained down to the lowest mask 7. At that time, an area including a barycenter determined at a stage higher than the respective stages is determined to be an area that had already been counted, so that the processing for calculating the barycenter is not performed. In that example, two persons are recognized at level n (the mask 5), one person is recognized at level 2 (the mask 6), and zero person is recognized at level 1 (the mask 7). That is to say, three persons are recognized in total.

Here, the labeling processing and the barycenter-calculation processing will be described below.

As shown in FIG. 5, a plurality of slices along the height direction is created from the distance information and made into a binary image. This binary image is subjected to labeling (separation), and the barycenter is calculated. The labeling is a method that is generally used for processing images, in which the number of clusters is counted. Then, a barycenter is counted per cluster. The above-described barycenter-calculation processing and a specific method for the labeling will be described with reference to FIGS. 7 to 9.

Figure 7:
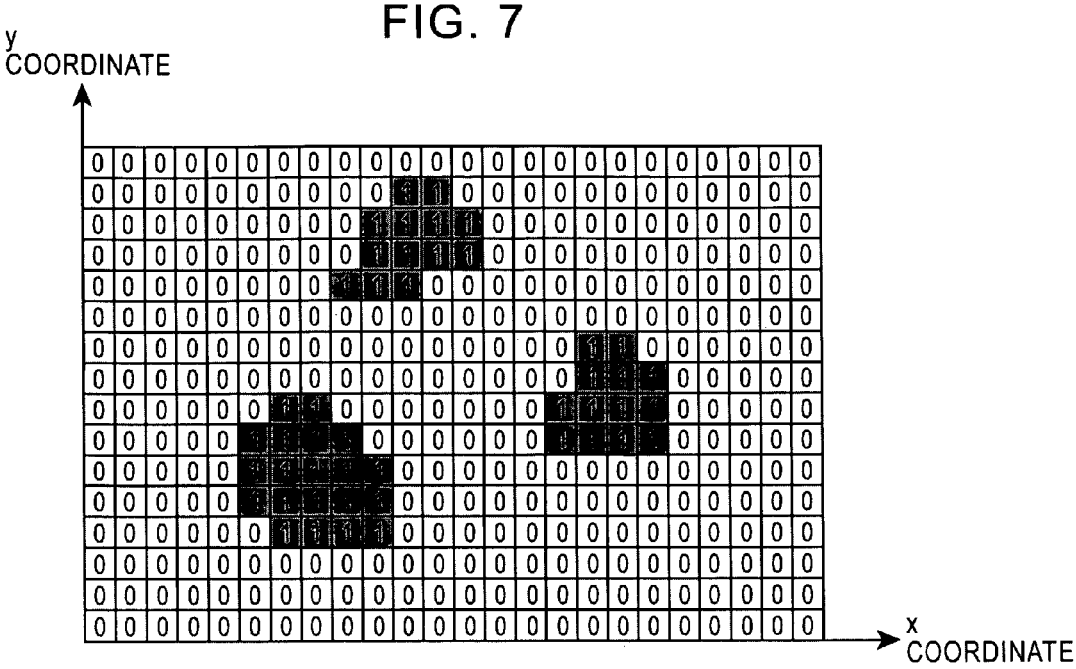
FIG. 7 shows an example binary image sliced off from a distance image.
Figure 8:
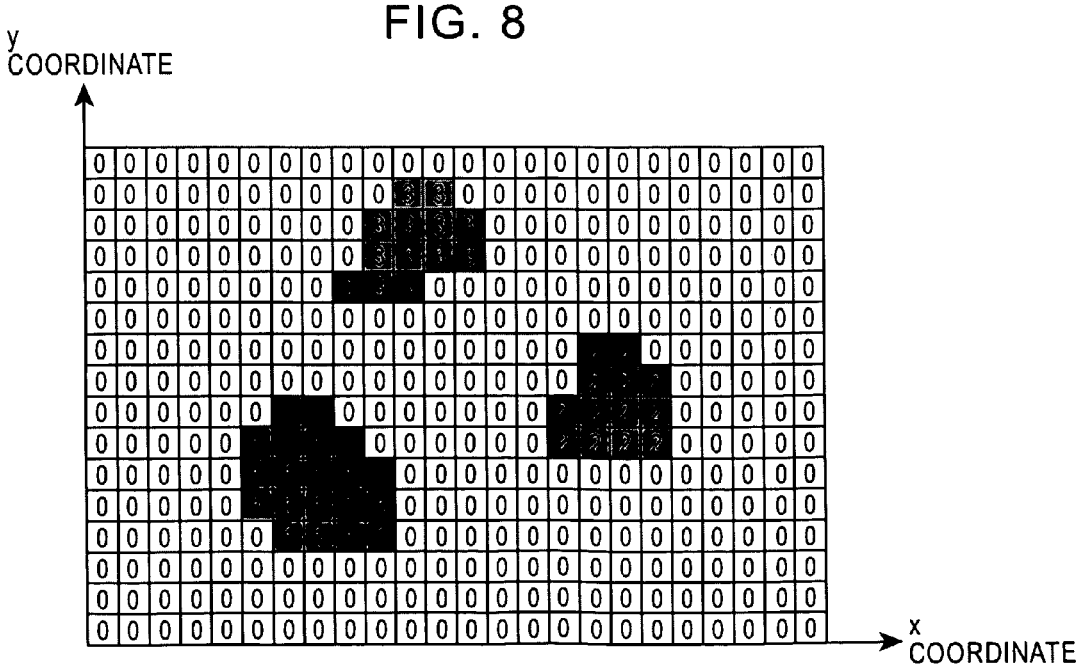
FIG. 8 shows the labeling result of FIG. 7.

FIGS. 7 and 8 illustrate the labeling processing. As shown in FIG. 7, a binary image is created on each stage (level) sliced off from an image at a predetermined distance. Then, connected components are labeled, as a single area, for the binary figure.

According to the labeling method, the whole pixels are scanned from bottom left to top right. As shown in FIG. 8, where a 1-pixel is subjected to the scanning, a first label is affixed to the pixel. Where the scanning is further performed and pixels subjected to the scanning are connected to the first label, the first label is also affixed to those pixels. Further, where the area of 1-pixel is different from the former area, a new label is affixed to the pixel. In FIG. 7, the binary image is divided into an area indicated by 1 and an area indicated by 0. However, after the labeling is performed, 0-areas functioning as the background and clusters are labeled individually, as shown in FIG. 8, in which case three clusters are recognized.

Figure 9:
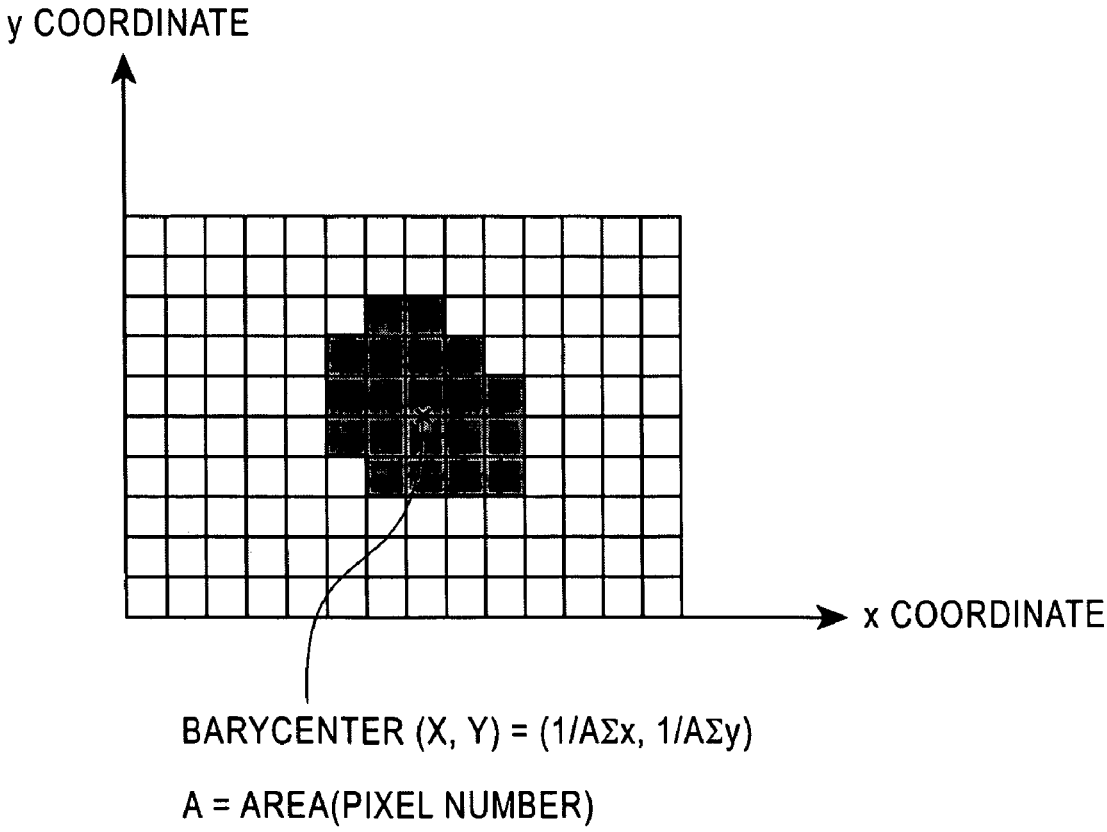
FIG. 9 illustrates barycenter calculation.

FIG. 9 illustrates how the barycenter is calculated. The barycenter is calculated per area (cluster) obtained after the labeling is performed. According to the calculation method, the entire x coordinates and y coordinates in the area are added to one another and divided by the pixel number (area), as shown in FIG. 9. The average value (average coordinates) thereof indicates the barycenter coordinates of the cluster.

According to an experiment, about fifteen people were recognized based only on the distance information in the view field of a single stereo camera 1 at the time of congestion. Further, at least ninety percent of people can be obtained in a congestion state such as stairs based only on the distance information. Further, the fact that the height of the above-described barycenter is within a predetermined area determines it to be a person, which is known as disclosed in Japanese Unexamined Patent Application Publication No. 5-328355.

[4] Actual barycenters are counted as people and determined to be the number of people.

[Line-tracking Processing]

Figure 10:
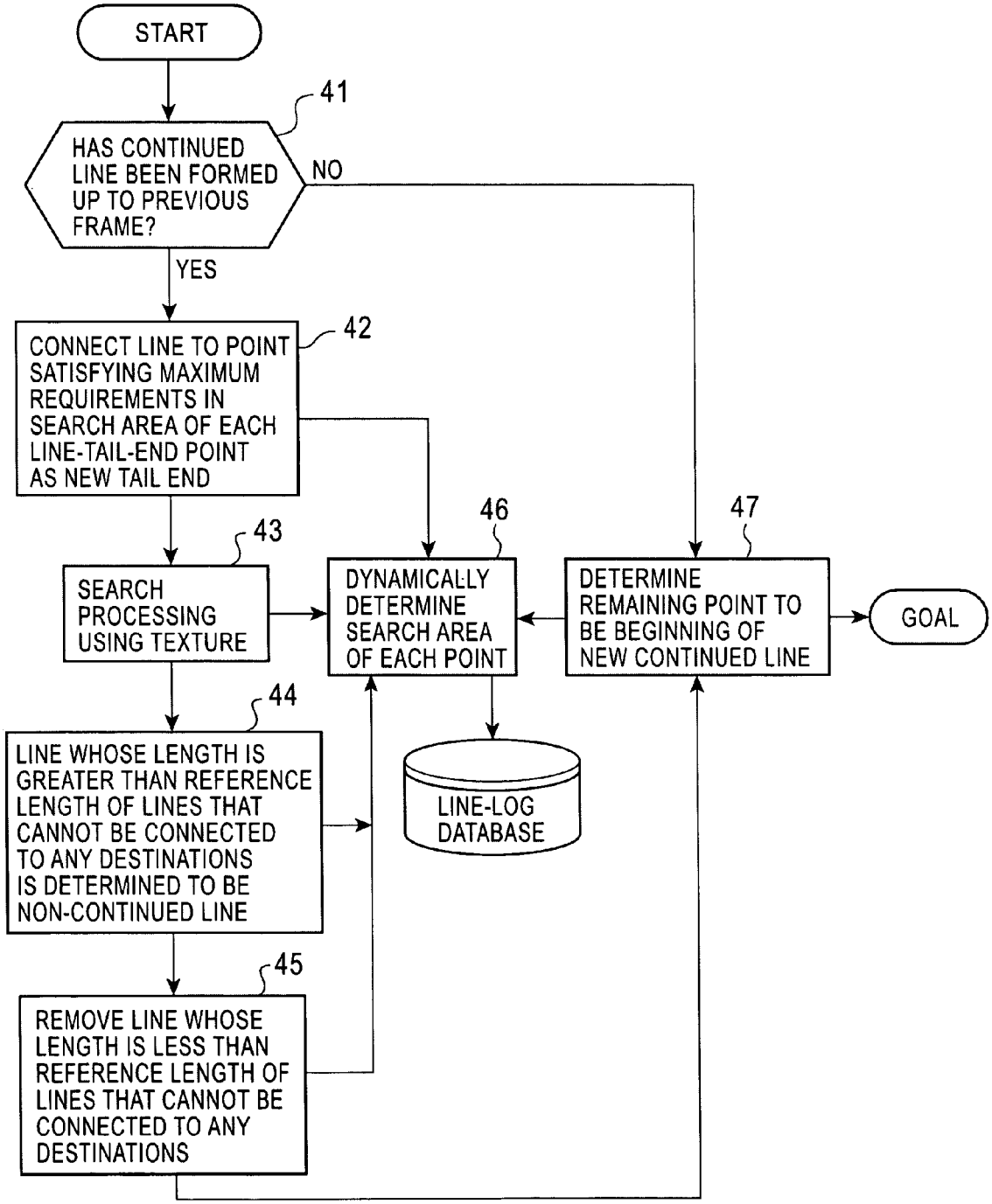
FIG. 10 is a flowchart of line tracking of the present invention.

Next, flow lines are generated by keeping track of the movement of the barycenters of people. FIG. 10 shows the flow of the line-tracking processing.

In the above-described manner, a person is recognized according to the barycenter information (distance information). However, where at least two barycenter data sets exist, particularly where the platform is congested, the barycenter data sets alone are not enough for determining whether or not a previous point and the next point indicate one and the same person with stability for connecting flow line (Only when a previous frame is compared to the next frame and only one person is shown in each of the moving search areas thereof, both the points are connected to each other and determined to be a flow line.).

Therefore, the person sameness is determined by using a higher-order local autocorrelation characteristic (texture information) that will be described later.

Figure 16:
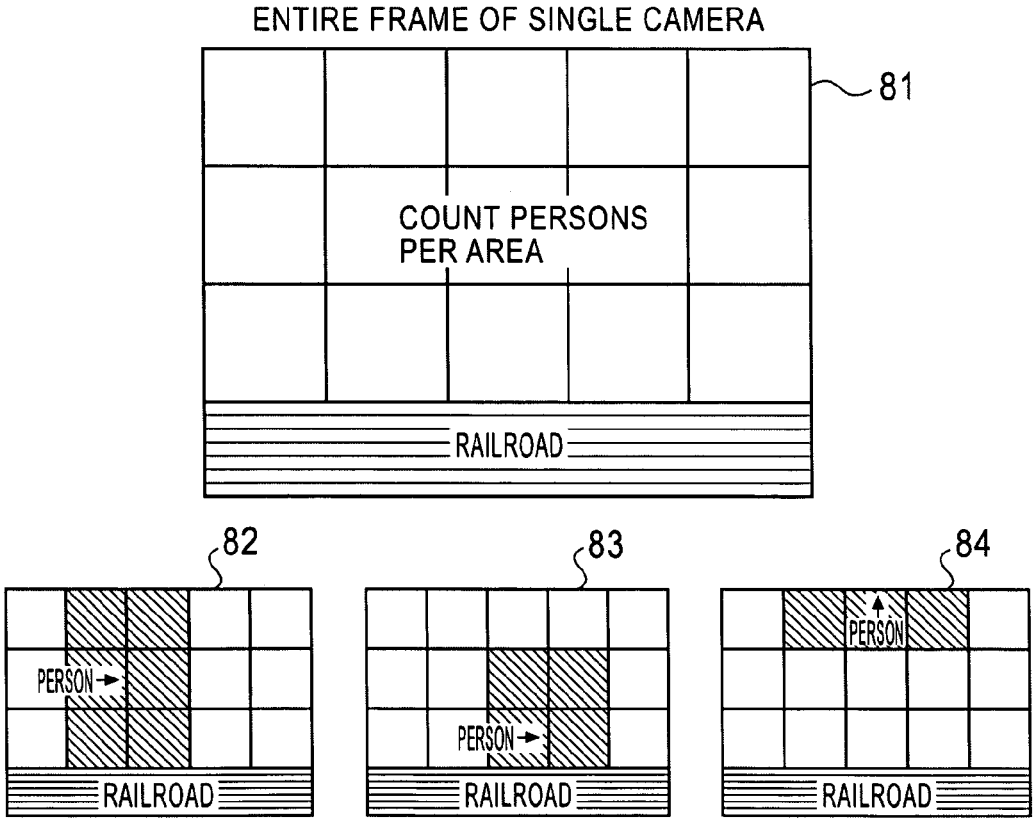
FIG. 16 shows a congestion-state map of the present invention.

The processing from then on will be described:

[5] On a screen showing an area covered by a single camera, an area where the z-axis value is correctly calculated is divided into 3×5 areas (a congestion-state map), and the number of people existing in the individual areas is counted (reference numeral 81 shown in FIG. 16). The above-described area covered by the single camera is referred to as a "frame".

[6] Next, lines (paths) up to the previous frame and the correspondence between the lines and people are checked and the centers of the same person are connected to one another as described below (reference numeral 42 shown in FIG. 10).

[7] Each of the lines has "the x coordinate", "the y coordinate", and "the z-axis value" for each frame after the appearance. Further, each of the lines has attribute data (that will be described later) including "the number of frames after the appearance", "the height level of a terminal end (four stages of mask images)", "a translation-invariant and rotation-invariant local characteristic vector obtained based on texture near a terminal end", "a travel direction (vertical and lateral)", and "the radius length of a search area".

[8] The checking is started from the oldest line of living lines (reference numeral 41 shown in FIG. 10).

[9] A search field is determined according to "the length of a single side of the search area" and "the travel direction" (Where "the number of frames after the appearance" is one, the determination is performed based only on "the length of a single side of the search area").

[10] The criteria for determining a person for the connection include, (A) The difference between the level and "the height level of a terminal end" is equivalent to one or less.

(B) "Although a predetermined amount of movement is recognized, an abrupt turn is made at an angle of 90° or more." does not hold true.

(C) Persons with the smallest linear dimensions therebetween, where the above-described two criteria are met.

[11] Where a destination that is to be connected to the line is found, "the number of frames after the appearance" is incremented, new values of "the x coordinate", "the y coordinate", and "the z-axis value" are added, and "the height level of a terminal end" is modified (reference numeral 46 shown in FIG. 10). Next, coordinates of the line a predetermined level earlier are compared to the new "x coordinate" and "y coordinate" and a new "travel direction" is determined (reference numeral 43 shown in FIG. 10). Next, in the congestion-state map, "the radius length of a search area" is determined according to the number of people existing in areas defined by removing three areas of the background from nine areas centered on itself, based on "the travel direction". Further, "a translation-invariant and rotation-invariant local characteristic vector obtained based on texture near a terminal end" is newly calculated.

[12] After the entire living lines are checked, of lines for which no destinations for the connection are found, a line whose number of frames after the appearance has a predetermined small value is eliminated as trash (reference numeral 45 shown in FIG. 10).

[13] A line that has a predetermined length or more and a terminal end that does not correspond to the edge of a screen is interpolated with texture. The search field is divided into small regions and local-characteristic vectors are calculated according to the texture of each of the regions. The distances between the local-characteristic vectors and "the translation-invariant and rotation-invariant local characteristic vector obtained according to texture near a terminal end" are measured. The processing [11] is performed using the center of a region with the nearest distance of regions with distances equivalent to a reference distance or less. If no region with a distance equivalent to the reference distance or less is found, connection is not performed.

Figure 20:
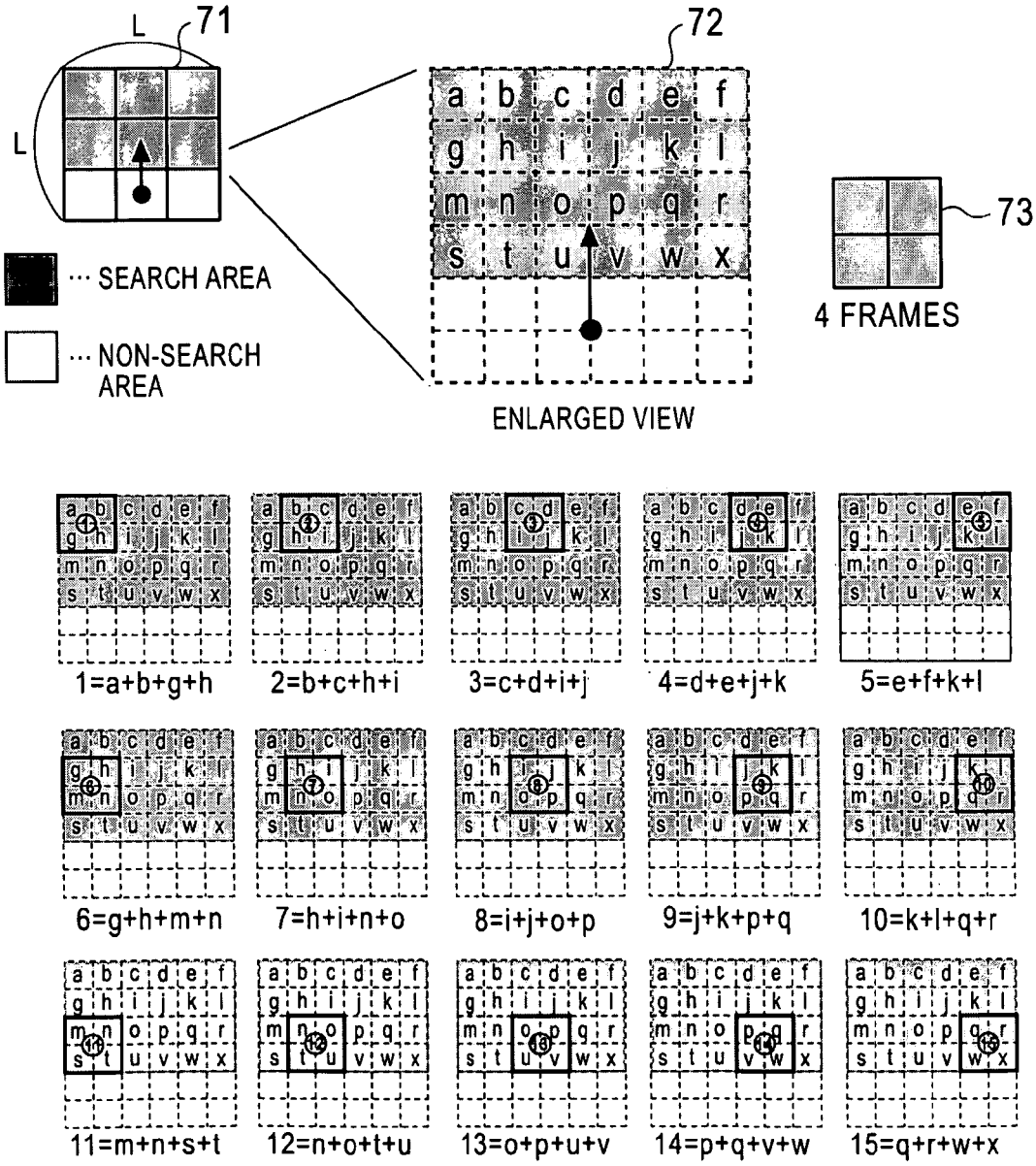
FIG. 20 illustrates a high-speed search algorithm by the higher-order local autocorrelation characteristic used for the present invention.

That is to say, where the distance information cannot be obtained for some reason, fifteen characteristic points in a search area of the current frame are counted and a point having the nearest characteristic of the characteristic points is determined to be the position where a new person exists, as is shown in an enlarged view (72) of FIG. 20.

In that case, where nothing exists in a search region determined by the travel direction, the speed, and the congestion state, it is determined that there is no destination for connection, whereby the flow line breaks.

[14] A line that has a predetermined length and that has no destination for connection is determined to be a dead line (reference numeral 44 shown in FIG. 10). The dead line is stored, as a log (the entire record of the flow line).

[15] A person who remains after the entire line processing is finished and who is not connected to any lines is determined to be the beginning of a new line (reference numeral 47 shown in FIG. 10). Of the attributes, "the radius length of a search area" is determined according to the number of people in an area around itself in the congestion-state map, as a rule (reference numerals 82 to 84 shown in FIG. 16). That is to say, since congestion decreases the recognition ability, the next search area is divided into small parts. The congestion state is determined according to the number of people obtained by the distance information, in principle (except when no distance information is obtained). At that time, even though the distance information is obtained as a cluster, the number of people can be counted, since a man has a width.

[Higher-order Local Autocorrelation Characteristic]

Next, the above-described "Recognition using a higher-order local autocorrelation characteristic" that is one of characteristics of the present invention will be described. The principle of "Recognition using a higher-order local autocorrelation characteristic" is specifically disclosed in "The theory and application of pattern recognition" (written by Noriyuki Otsu et al., the first edition, 1996, Asakura-shoten). According to the present invention, the above-described "Recognition method using higher-order local autocorrelation" is expanded, so as to be rotation-invariant, and is used for a monitoring system on a platform.

Since the higher-order local autocorrelation characteristic is a local characteristic, it has a translation-invariant property and an additive property that will be described later. Further, the higher-order local autocorrelation characteristic is used, so as to be rotation-invariant. That is to say, where one and the same person changes his walking direction (a turn seen from on high), the above-described higher-order local autocorrelation characteristic does not change, whereby the person is recognized as the same person. Further, the higher-order local autocorrelation characteristic is calculated per block for performing high-speed calculation using the additive property and maintained for each block.

Figure 17:
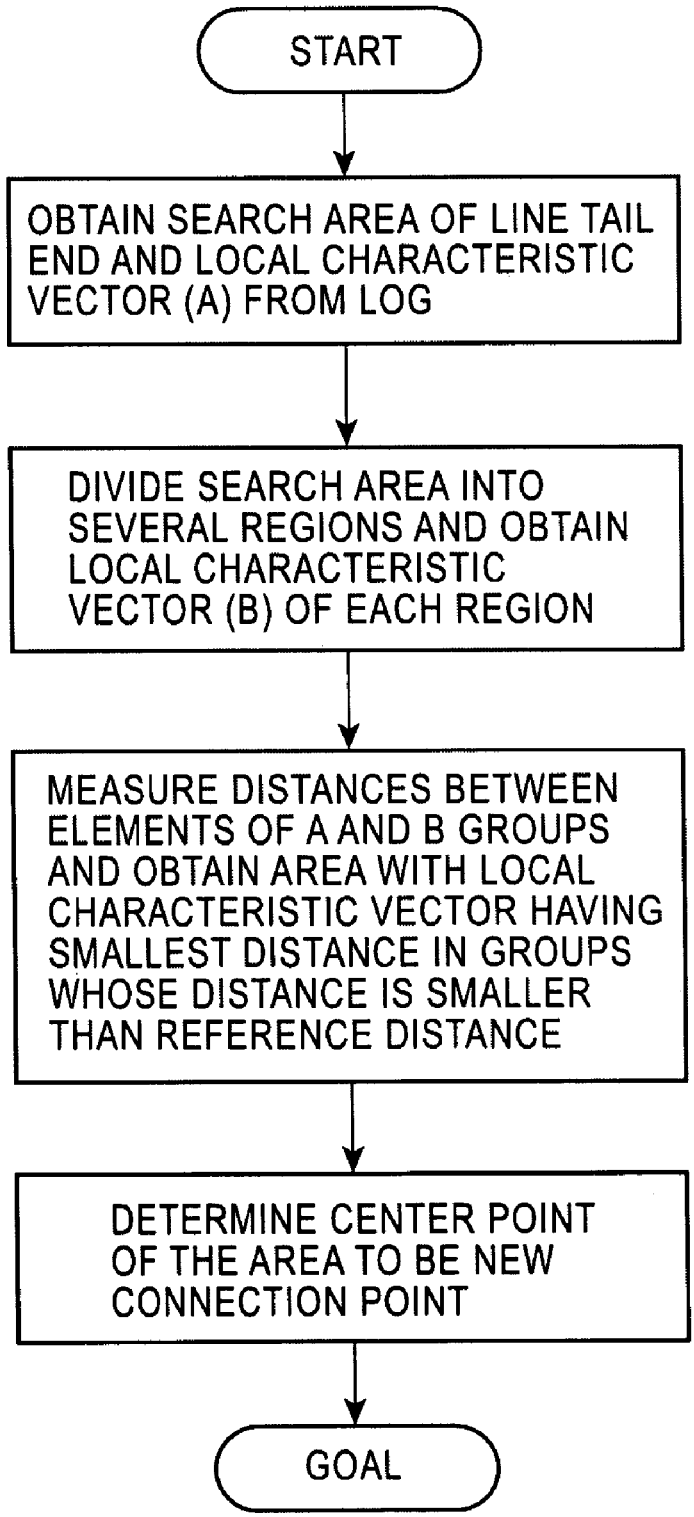
FIG. 17 is a flowchart showing search processing using texture according to the present invention.

Thus, where a person in one block moves to another block, the above-described barycenter information exists in both the blocks. However, by determining whether or not the higher-order local autocorrelation characteristic of the above-described first block is the same as that of the next block, it is determined whether or not the above-described barycenter information (the person information) existing in both the blocks indicates one and the same person. In this manner, flow lines at the front and back of the same person can be connected. The flow line is created by connecting barycenter points. The flow of this search processing using texture is shown in FIG. 17.

The recognition using the higher-order local autocorrelation characteristic will be described below with reference to FIGS. 11 to 14.

Recognition Using Higher-order Local Autocorrelation Characteristic

First, the characteristic of an object is extracted from image (texture) information.

A higher-order local autocorrelation function used here is defined as below. Where an object image in a screen is determined to be f(r), an N-th-order autocorrelation function is defined by:

(Mathematical Expression 1)

$$x^N(a_1, a_2, \ldots, a_N)=\int f(r)\ldots f(r+a_1)\ldots f(r+a_N)dr$$

with reference to displacement directions (a1, a2, a3, . . . aN). Here, an order N of a higher-order autocorrelation coefficient is determined to be two. Further, the displacement directions are limited so as to fall within a local 3-by-3-pixel region around a reference point r. After removing equivalent characteristics generated by translation, the number of characteristics for the binary image is twenty-five in total (the left side of FIG. 11). Each of the characteristics is calculated by adding the product of values of pixels corresponding to the local pattern to the entire pixels, so that the amount of characteristics of a single image is obtained.

This characteristic is significantly advantageous, because it is invariant for a translation pattern. On the other hand, according to the method for extracting only an object area using distance information transmitted from the stereo camera, where the method is used for preprocessing, even though an object can be cut off with stability, the cut-off area is unstable. Therefore, by using the translation-invariant characteristic for recognition, robustness for changes in cutting is ensured. That is to say, the advantage of translation invariance of the characteristic is exploited to capacity for the fluctuation in the object position in a small area.

Figure 11:
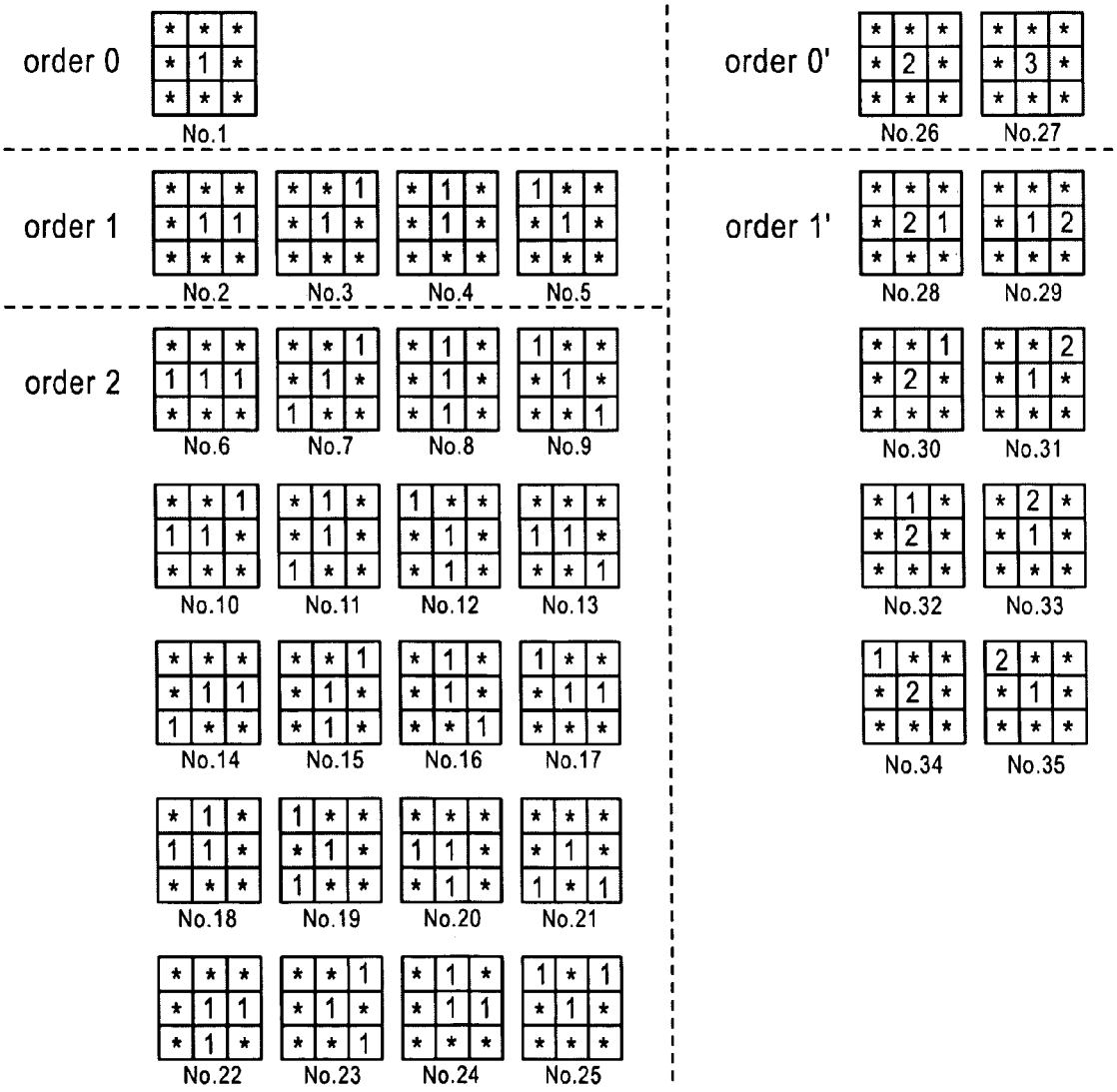
FIG. 11 illustrates a translation-invariant higher-order local autocorrelation characteristic.
Figures 12, 13:
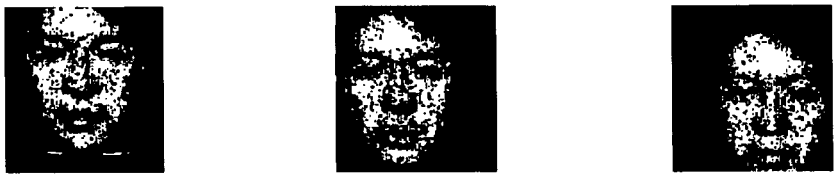
FIG. 12 shows example approximate vectors.
FIG. 13 shows example images of the same face, where the images are displaced from one another due to cutting.

FIG. 11 shows twenty-five+ten=thirty-five higher-order local autocorrelation characteristics. The center of a mask of the 3-by-3 size indicates the reference point r. Pixels designated by "1" are added and pixels designated by "*" are not added. Where an order is determined to be two, twenty-five patterns shown on the left side of the drawing are created. However, for revising (normalizing) a significantly different range of the sum of products in the case of the 0-th order and the first order, a pattern for summing products of the same point only in the case of the 0-th order 0 and the first order is added so that thirty-five patterns are generated in total. However, even though the patterns are translation-invariant, they are not rotation-invariant. Therefore, as shown in FIG. 14, the patterns are compiled so that patterns that turn and become equivalent to one another are added, so as to be a single element. As a result, a vector having eleven elements is used. Further, where four patterns are made into a single element for normalizing the values, a value divided by four is used.

Specifically, the 3-by-3 mask shifts on the object image by one pixel and scans the entire object image. That is to say, the 3-by-3 mask is moved on the entire pixels. At that time, values obtained by multiplying the values of pixels marked with 1 by one another are added to one another every time the 3-by-3 mask is moved in pixels. That is to say, the product sum is obtained. Numeral 2 indicates that the value of the corresponding pixel is multiplied two times (the second power) and numeral 3 indicates that the corresponding pixel is multiplied three times (the third power).

After the operations are performed for the entire masks of thirty-five types, an image with an information amount of (8 bit)×(x-pixel number)×(y-pixel number) is converted into an eleven-dimensional vector.

Then, the most characteristic point is that those characteristics are invariant for translation and rotation, since the characteristics are calculated in local areas. Therefore, although a cut from the stereo camera is unstable, characteristic amounts of dimensions approximate to one another even though a cut area for the object is displaced. Such an example is shown in images of FIG. 12 and a table shown in FIG. 13. In this example, the two upper digits of vector elements for gray images in twenty-five dimensions are shown. Although three cut face images are displaced with respect to one another, the two upper-digit elements of vectors shown in the table approximate to one another in all respects. Where a method using template matching is simply used, the cut displacement due to the distance information definitively affects the recognition rate. That is to say, the characteristic is robust for cut inaccuracy, which is the largest advantage obtained by using the higher-order local autocorrelation characteristic and the stereo camera in combination.

Further, as for the values of pixels of an image, an 8-bit gray image is considered to be the reference in this embodiment. However, the characteristic may be obtained for each of three-dimensional values such as RGB (or YIQ) using a color image. Where the image is eleven dimensional, it may be made into a one-dimensional vector in thirty-three dimensions so that the precision can be increased.

[Dynamic Search-Region Determination Processing]

Here, dynamic control over the above-described search area will be described using FIGS. 15, 16, 18, and 19.

Figure 15:
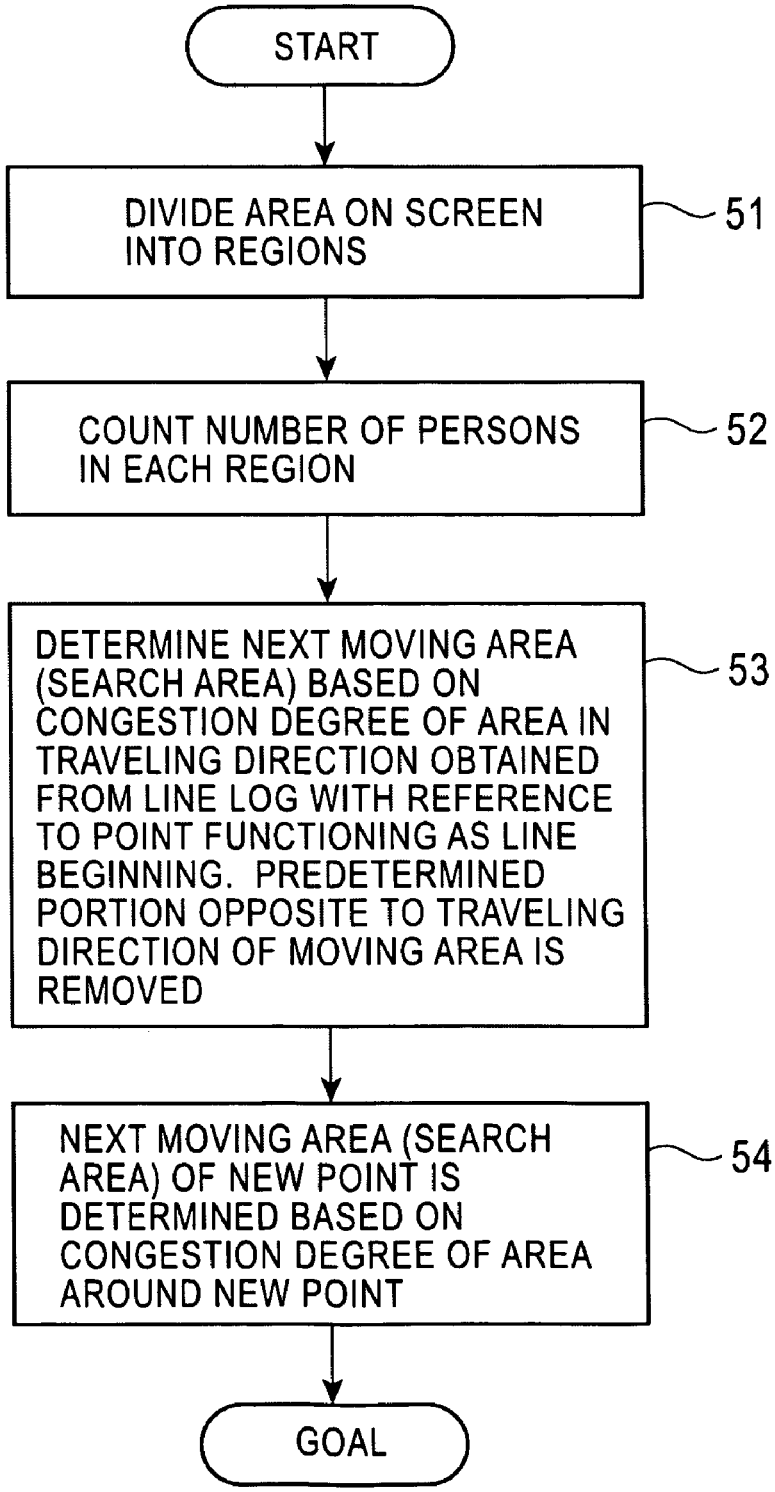
FIG. 15 is a flowchart showing search-area dynamically-determination processing of the present invention.

[1] First, an area from which distance data can be correctly obtained is divided into a plurality of parts on a single screen (reference numeral 51 shown in FIG. 15 and reference numeral 81 shown in FIG. 16).

[2] Since points indicating (considered as) the centers of people are obtained by the center-of-person determination-and-count processing, counting is performed for determining how many people exist in each area (reference numeral 52 shown in FIG. 15 and reference numeral 81 shown in FIG. 16).

Figure 18:
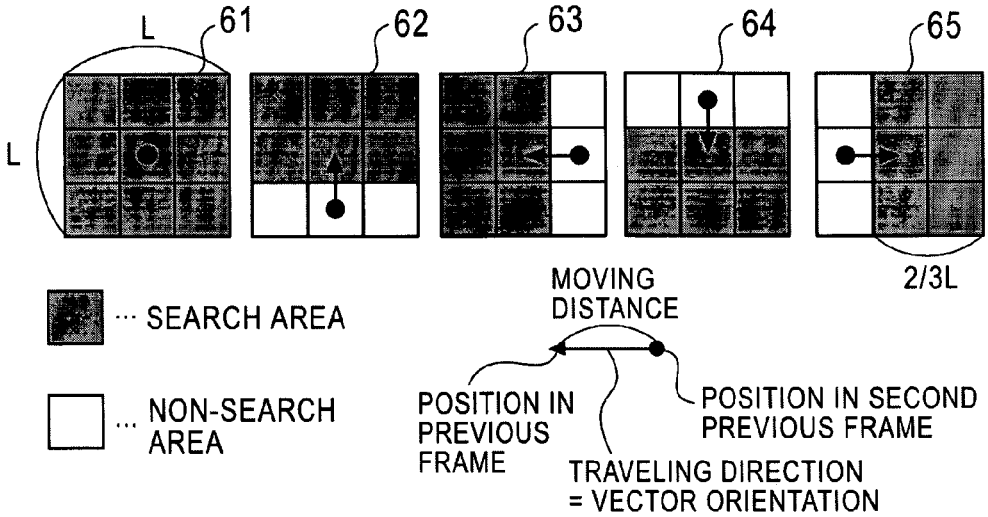
FIG. 18 illustrates a dynamic search-area determination algorithm of the present invention.

[3] For a point that is newly determined to be the end of the line, a travel direction in the next frame is determined using the line log (reference numeral 53 shown in FIG. 15 and reference numerals 61 to 65 shown in FIG. 18).

Figure 19:
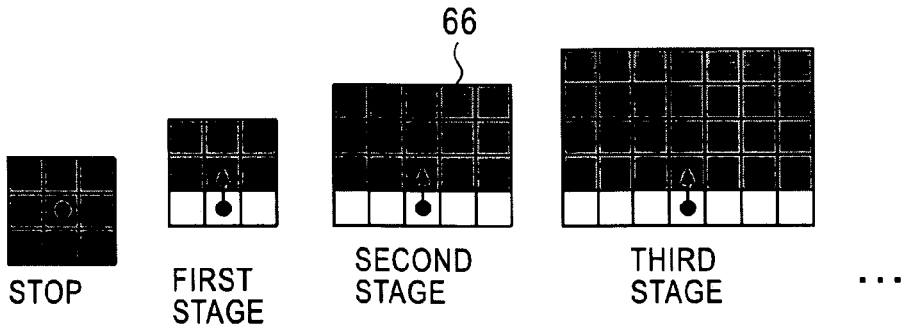
FIG. 19 illustrates a change in the dynamic search area of the present invention according to the congestion degree.

[4] As shown in FIG. 18, a high priority is given to the travel direction in the periphery of a region in which the point exists. Further, as shown in FIG. 16, the number of persons in a selected area is counted, the person number is multiplied by a predetermined constant, and the region of a search area is determined (reference numeral 54 shown in FIG. 15). Specifically, as shown in FIG. 19, starting from the resting state, the search area is dynamically modified in multi stages according to the congestion degree and the speed, and the flow lines are connected to one another or searched. In the search area, in the direction opposite to the travel direction, a predetermined and appropriately small value is determined to be the radius of the search area.

[5] As for the point of a person that is not connected to an existing line and considered as a newly arrived person, the area therearound is dealt in the same manner, the person number is counted, and the person number is multiplied by a predetermined constant and determined to be the radius of the search area.

[Texture High-Speed Search Processing]

Next, an idea for performing texture search processing of the present invention with high speed will be described using FIG. 20.

Where a search area of the first stage shown in FIG. 19 (reference numeral 71 shown in FIG. 20) is used as an example, as shown by reference numeral 72 of FIG. 20 for example, the above-described search area is divided into twenty-four blocks and calculated, and a higher-order local autocorrelation characteristic is maintained for each block.

After that, first, an area where a person exists, the area being an object in a previous frame, is maintained in four blocks indicated by reference numeral 73 of FIG. 20. The higher-order local autocorrelation characteristics are compared to one another, where the above-described four blocks are determined to be a single unit, and the next destination is searched. Further, the size of the four blocks is a size that can include about a single person. Therefore, the four-blocks hardly include a plurality of persons. If the barycenter information about at least two persons exists, the person at shorter distance is recognized. Then, recognition is made according to the similarity degree of texture.

Where a loose search for the four blocks is made only for fifteen points, as shown in [1] to [15] shown in the lower part of FIG. 20, the calculation amount can be significantly reduced. The higher-order local autocorrelation characteristic is translation-invariant and rotation-invariant. Therefore, an approximate vector can be obtained even though a person is not exactly in an area of the above-described four blocks, so long as about seventy percent of an object falls within the above-described four-block area. Subsequently, loose search can be adequately performed. Further, in contrast to ordinary image search, the vector calculation described in [1] is shown by a mathematical expression a+b+g+h, since the higher-order local autocorrelation function is additive. That is to say, addition of one-dimensional vectors is adequate. By performing the loose search using the additive property, the calculation amount is reduced by more than half. That is to say, characteristic points at the fifteen positions shown in [1] to [15] of FIG. 20 in a search area of the current frame are calculated and a point with the nearest characteristic point of the fifteen characteristic points is newly determined to be a region where the same person exists. As shown by reference numeral 72 in FIG. 20, the characteristic was divided into twenty-four blocks (a, . . . , x) and calculated in advance, which is an idea for reducing the calculation amount that is shown, as fifteen positions×four blocks=sixty blocks to the calculation amount of twenty-four blocks.

The summary of the above-described processing will be as described below.

Method for determining a flow line in search area

1. Barycenters of a person obtained by distance information are connected in a search area.

2. Where the barycenters cannot be obtained in the search area from the distance information, a search is made by freely-rotatable information (a high-order local autocorrelation characteristic) using texture information.

3. The precision of a flow line is increased using the distance information+the texture information.

That is to say, basically, the flow line is obtained by using the distance information and the higher-order local autocorrelation characteristic is used, where no person exists in the search area.

High-speed Search Method for Texture

1. The higher-order local autocorrelation characteristic is divided into twenty-four blocks in a search area in one operation.

2. A comparison of the characteristic amounts of an object stored in the last operation is made in the search area based on the Euclidean distance of a vector.

By maintaining the characteristic per block in the last operation, the characteristic amount at each position can be calculated with high speed by four additions.

Further, the above-described Euclidean distance will now be described.

Where the flow line of a person is calculated by comparing a local characteristic obtained from the next previous area where a person existed (hereinafter, the "higher-order local autocorrelation characteristic" will be simply referred to as a "local characteristic".) to the local characteristic of the area of a candidate of the current frame, where it is considered that the person moved to the area, first, the flow line is connected to a nearer candidate based on the x-y two-dimensional coordinates of a platform where the person exists, where the x-y two dimensional coordinates are obtained by a distance image. Hitherto, a distance on generally-used two-dimensional coordinates has been discussed. However, where a candidate for connection exists at the same distance on the platform, or is unknown, the reliability is increased by performing calculation by the vector of the local characteristic obtained from the texture. Hereinafter, the above-described local characteristic is used for determining whether or not obtained regions show the same object (pattern) (The coordinates are entirely different from the coordinates on the platform.).

Where the local characteristic (texture) of an area of the next previous position of itself and the local characteristic of an area of a candidate point obtained from the distance=two vectors:

$$A=(a1, a2, a3, \ldots, an)$$

$$B=(b1, b2, b3, \ldots, bn)$$

exist, an Euclidean distance is calculated by taking the root-mean square average and expressed, as $\sqrt{((a1-b1)\text{ squared}+(a2-b2)\text{ squared}+(a3-b3)\text{ squared}+\ldots+(an-bn)\text{ squared})}$. In the case of the same texture, the distance becomes zero. The rules of the calculation method are the same as an ordinary linear-dimensions calculation method up to three dimensions.

Figure 21:
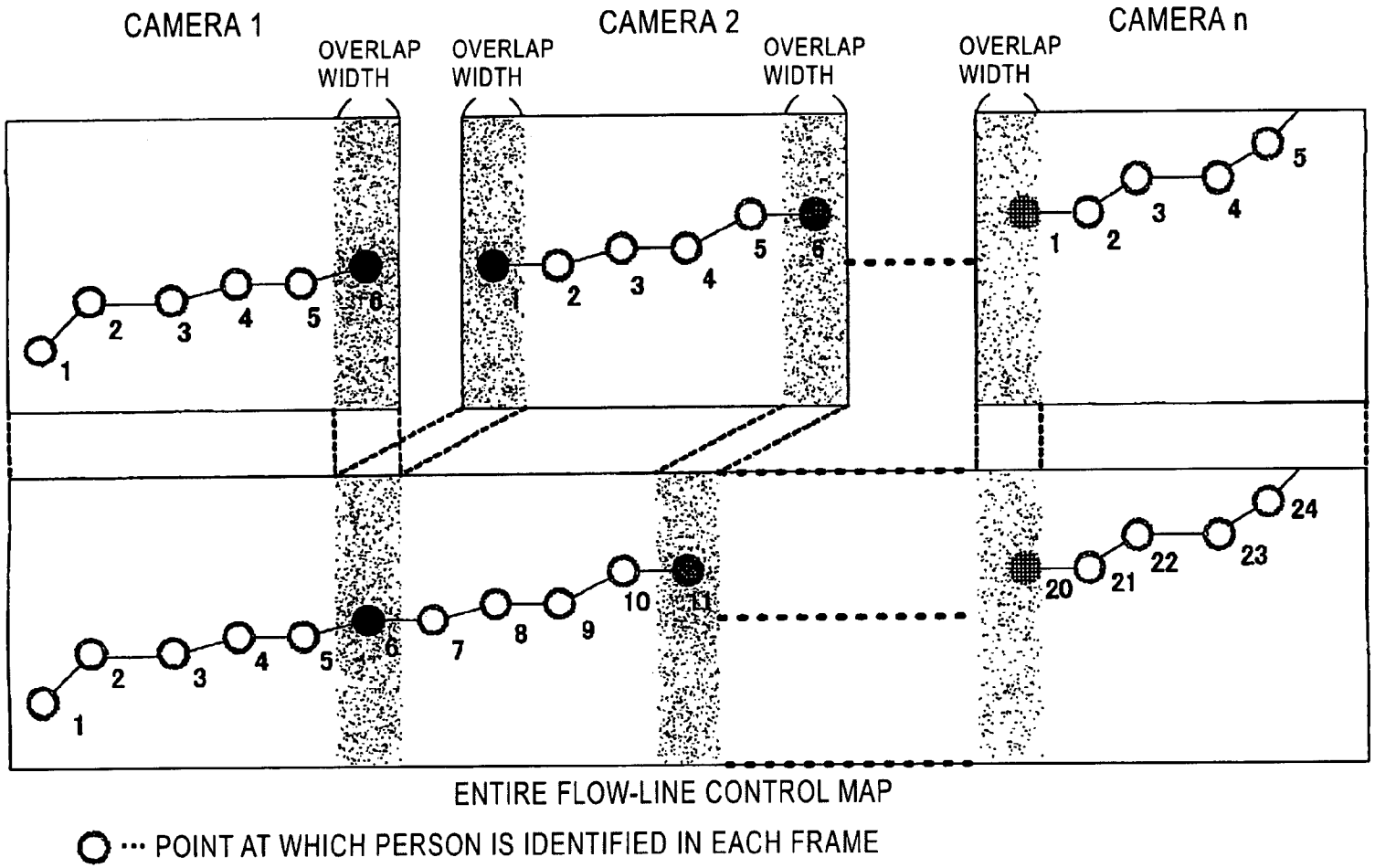
FIG. 21 illustrates an entire flow-line control algorithm of the present invention.

FIG. 21 shows a specific example of the above-described entire flow-line control algorithm.

The flow line of a person is determined per camera.

Time-synchronization is established between the cameras and adjacent cameras are positioned so that continuous two-dimensional coordinates can be set using common regions (overlap widths). Further, by integrating the flow-line information of the cameras, flow lines in the view fields of all the cameras can be created on an entire control map.

In the case of FIG. 21, each camera determines a person by itself and connects the flow lines thereof. Here, since the two-dimensional coordinates and time of the sixth point of the camera 1 match with those of the first point of the camera 2, the points are controlled as a continuous flow line on the entire flow-line control map. Accordingly, the entire flow lines in the two-dimensional coordinates created by the plurality of cameras can be controlled.

For connecting the flow lines, the reliability can be increased by using not only the time and the two-dimensional coordinates, but also the height (stature) and the texture information (the color of a head and clothing).

[Region Monitoring and Warning Processing]

Figure 22:
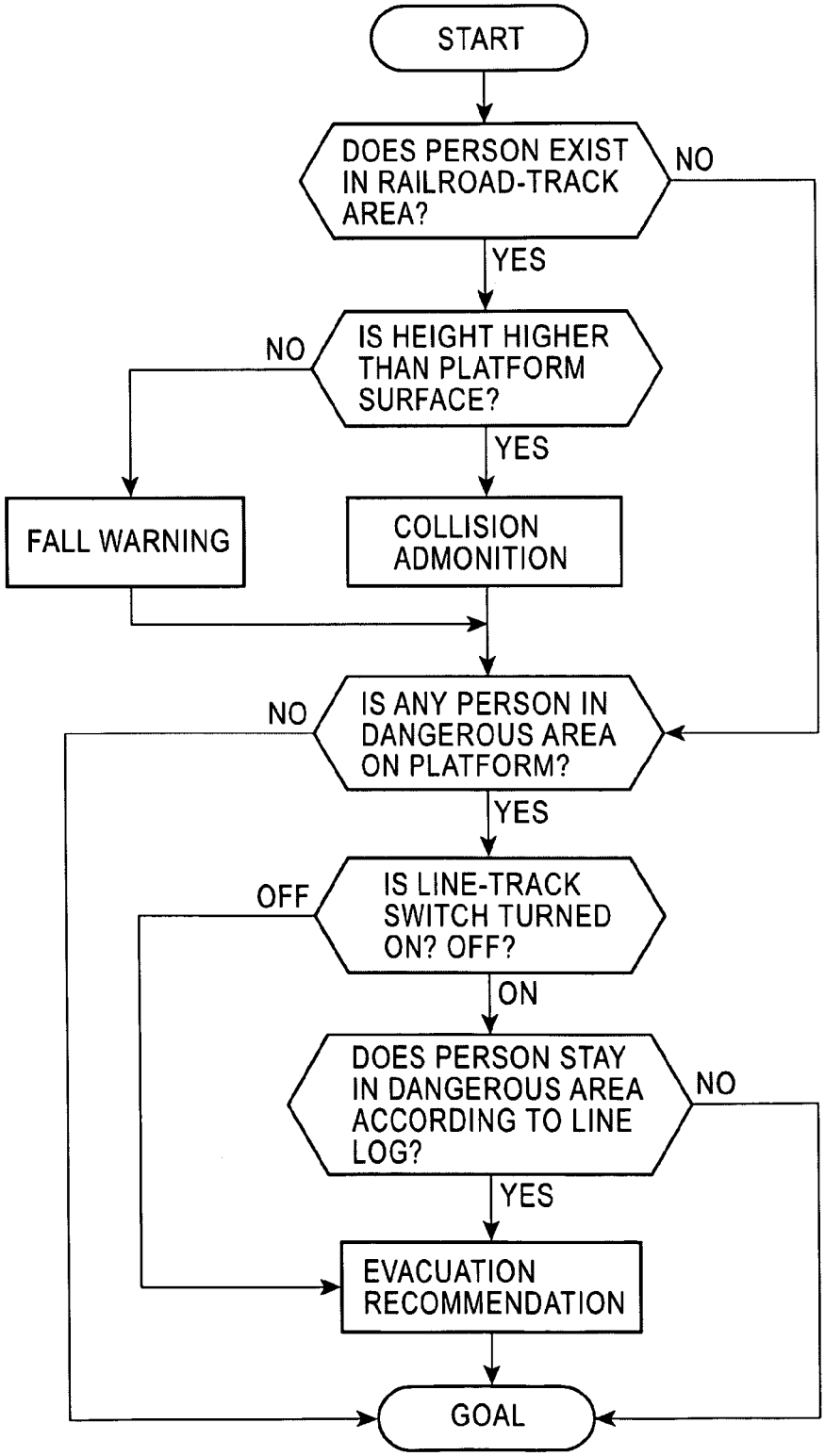
FIG. 22 is a flowchart of area-monitoring-and-warning processing of the present invention.

Next, the flow of region monitoring-and-warning processing will be shown in FIG. 22.

The flow of region monitoring-and-warning processing shown in FIG. 22 (the algorithm of fall determination or the like) is as described below.

[1] Where a person exists in a predetermined area on a railroad track and the height thereof is higher than the platform (1.5 m, for example), (where only the hand is outside the platform, for example), collision-admonition processing is performed. Where the height is lower than the platform, it is determined that the person fell and fall-warning processing is performed.

[2] Where a person exists in a dangerous region on the platform and line tracking is not performed, evacuation-recommendation processing is immediately performed. Further, where the line tracking is performed and where it is determined that the person stays in the dangerous region according to the log, the evacuation-recommendation processing is performed.

As has been described, the system of the present invention provides means for previously recording the states where a warning should be given in advance according to the position, movement, and so forth of a person on the edge of the platform, and the state where the announcement and image thereof are transferred. Further, by adding the speech-synthesis function to the cameras, the announcement corresponding to the state is made for passengers per camera by synthesized speech that was previously recorded.

The above-described processing is as laid out below.

1. Automatic detection of fall: Distance information is determined according to a still image and dynamic changes.

Since the distance information is used, the fall can be detected with stability in the case where morning sunlight or evening sunlight gets in, or shadows significantly change. Further, a newspaper, corrugated cardboard, a dove or a crow, and a baggage can be ignored.

Determination result is reported in three steps, for example.

a. a fall without fail→A stop signal is transmitted and a warning is generated.

b. something may exist→The image is transferred to the staff room.

c. a dove or trash without fail→Ignore them.

The following two types of determinations can be made for the circumstances where a person exists on a railroad track.

a. A person fell from the platform.

b. A person walks from the railroad-track side.

A warning can be made for an entity in a dangerous area (as closely as possible to the edge of the platform).

a. A person is warned by speech. If the person does not move, the image is transferred.

b. If the entity is a baggage, the image is transferred.

Only time-series distance information obtained from a gray image is used here.

2. Tracking of the person movement: Tracking of distance information is performed using a still image, as well as texture information (a color image).

A flow line can be controlled in real time without being confused in the state of congestion by people.

Since the texture can be tracked with respect to the higher-order local autocorrelation characteristic that can cope with position and rotation, tracking can be performed with increased precision using both the distance and the texture.

Since an area for person tracking is dynamically changed according to the congestion state, tracking can be achieved at a video rate.

Since both the distance information and the texture information are used, it becomes possible to perform intersection determination for determining the trails of persons with increased precision, where the persons cross each other.

INDUSTRIAL APPLICABILITY

As has been described, according to the system of the present invention, the platform edge is picked up by the plurality of stereo cameras at the edge of the station platform on the railroad-track side and the position of a person on the platform edge is recognized according to the distance information and the texture information. Therefore, it becomes possible to provide a more reliable safety monitoring device on the station platform, where the safety monitoring device detects the fall of the person at the platform edge on the railroad-track side onto the railroad track with stability, recognizes at least two persons, and obtains the entire action log thereof.

Further, in the above-described system, means for obtaining and maintaining the log of a flow line of a person in a space such as a platform is provided. Further, means for extracting a recognition object based on image information transmitted from the stereo cameras performs recognition through a high-resolution image using higher-order local autocorrelation. Accordingly, the above-described recognition can be performed with stability.

Further, in the above-described system, means for recognizing an object through both the above-described distance information and image information discerns between a person and other things from the barycenter information on a plurality of masks at various heights. Further, in the above-described system, the above-described distance information and image information at the platform edge are obtained, image information of above the railroad-track area is detected, the fall of a person or the protrusion of a person or the like toward outside the platform is recognized according to the distance information of the image information, and a warning is issued. Accordingly, a reliable safety monitoring device in a station platform with an increased safety degree can be provided.

The invention claimed is:

1. A safety monitoring device in a station platform, the safety monitoring device comprising:

image processing means for picking up a platform edge through a plurality of stereo cameras at the platform edge on a railroad-track side of a station and generating image information based on a picked-up image in a view field and distance information based on a coordinate system of the platform per stereo camera, means for recognizing an object based on distance information and image information transmitted from each of the stereo cameras, and means for confirming safety according to the state of the recognized object; wherein the means for recognizing the object based on the distance information and the image information transmitted from each of the stereo cameras performs recognition using a higher-order local autocorrelation characteristic, said higher-order local autocorrelation characteristic is used for determining whether ahead and behind time-series distance information existing at predetermined positions in a predetermined area pertains to a same person, and the predetermined positions correspond to a plurality of blocks obtained by dividing the predetermined area, and a next search for the time-series distance information is performed by calculating the higher-order local autocorrelation characteristic for at least two blocks of said plurality of blocks.

2. The safety monitoring device in the station platform according to claim 1, the safety monitoring device further comprising means for obtaining and maintaining a log of a flow line of a person in a space such as the platform.

3. The safety monitoring device in the station platform according to claim 1, wherein the means for recognizing the object based on said distance information and image information discerns between a person and other objects based on barycenter information on a plurality of masks at various heights.

4. The safety monitoring device in the station platform according to claim 1, wherein the means for confirming the safety obtains said distance information and image information of the platform edge, detects image information of railroad-track area information, recognizes a fall of a person or a protrusion of a person or the like toward outside the platform according to the distance information of the image information, and issues a warning.

5. A safety monitoring apparatus in a station platform comprising:

an image processor configured to detect a platform edge through a plurality of stereo cameras at the platform edge on a railroad-track side of a station and generate image information based on a picked-up image in a view field and distance information based on a coordinate system of the platform from each stereo camera;

a recognition processor configured to recognize an object based on the image information and the distance information from each stereo camera and confirm safety based on the state of the recognized object, wherein the recognition processor is configured to recognize the object based on the image information and the distance information from each stereo camera by performing recognition using a higher-order local autocorrelation characteristic, the higher-order local autocorrelation characteristic is used for determining ahead and behind time-series distance information existing at predetermined positions in a predetermined area as pertaining to a same person, and the predetermined positions correspond to a plurality of blocks obtained by dividing the predetermined area, and a next search for the time-series distance information is performed by calculating the higher-order local autocorrelation characteristic for at least two blocks of the plurality of blocks.

* * * * *